United States Patent [19]

Phelps

[11] Patent Number: 4,469,003

[45] Date of Patent: Sep. 4, 1984

[54] TUBE CHIMES

[76] Inventor: Sidney J. Phelps, 2803 W. 34th, Anchorage, Ak. 99503

[21] Appl. No.: 422,239

[22] Filed: Sep. 23, 1982

[51] Int. Cl.[3] ..... G10D 13/08

[52] U.S. Cl. ..... 84/404

[58] Field of Search ..... 84/402, 404, 403, 406

[56] References Cited

U.S. PATENT DOCUMENTS

| | | | |
|---|---|---|---|
| 644,817 | 3/1900 | Deagan | 84/402 |
| 864,461 | 8/1907 | Gibbs | 84/404 |
| 1,100,671 | 6/1914 | Deagan | 84/403 |
| 2,588,295 | 3/1952 | Rowe | 84/1.04 |
| 2,770,159 | 11/1956 | Kato | 84/404 |
| 3,589,233 | 6/1971 | Rowe | 84/402 |

*Primary Examiner*—Donald A. Griffin

*Attorney, Agent, or Firm*—William D. Hall

[57] ABSTRACT

A plurality of vertical, elongated tubes are suspended longitudinally between a horizontal upper cross-piece and a horizontal lower cross-piece of a frame. Flanking the elongated tube on each side thereof is a striker element which is also suspended between the upper cross-piece and the lower cross-piece, the suspended, elongated tube and the two suspended striker elements on either side representing a single tube assembly. Interposed between adjacent tube assemblies are longitudinal frame pieces. Pivoting the upper cross-piece about a stationary point on the lower cross-piece results in the striker elements reciprocating laterally. When moving in one direction, a striker element contacts the elongated tube; in the opposite direction, the striker element contacts a longitudinal frame piece. Resilient pads are located on the longitudinal frame pieces where the striker elements make contact, thereby decreasing the sound of a striker element as it strikes a longitudinal frame piece. Each elongated tube is provided with a damper at one end which can be selectively directed against one end of the tube by the player of the instrument.

22 Claims, 1 Drawing Figure

TUBE CHIMES

FIELD OF THE INVENTION

The present invention relates to apparatus for producing one or a plurality of preselected tones. Specifically, the invention relates to percussion musical instruments which are preferably hand held and which include a plurality of elongated tubular chimes which are struck by a striker element.

TECHNOLOGICAL CONTEXT OF THE INVENTION

The notion of generating tones by striking a tubular chime is well known. In U.S. Pat. No. 644,817 to Deagan, a plurality of metal tubes are vibrated to generate musical tones. Specifically, Deagan teaches a plurality of tubes which hang from cross-bars (h) and extend down into slots formed in a sounding board (e). According to Deagan, the tubes which are metal are "screwed" into the sounding board but can move slightly laterally where the cross-bars pass therethrough. Deagan suggests that the instrument may be played by shaking the frames or by striking them with the hand or a mallet. In this Deagan patent, no element is shown which strikes the tubes when the instrument is moved.

In U.S. Pat. No. 1,100,671, a plurality of parallel chimes are suspended from a top rail (15) by means of suspender loops (19). At the lower portion of each chime, separator bars are provided between chimes to keep one chime from striking another when either is moved in lateral motion. The separators are faced with rubber to decrease the sound generated when the tubes strike the separators. In this patent, the tubes "hang free so that they may vibrate when struck" or are otherwise operated upon to set up a vibration. As in the previous Deagan reference, no specific means for striking the chimes is provided.

Two patents to Rowe, U.S. Pat. Nos. 2,588,295 and 3,589,233, disclose apparatus for producing chime tones. In each invention, a resilient bar (11) is suspended by cords (12, 13). To effectuate a desired tone, a magnetic assembly is provided in which a plunger or striker is driven to impact the bar at one of its ends. In accordance with the Rowe tone generators, each resilient bar has an elongated portion with a bent end portion extending perpendicularly from the elongated portion. To generate a tone, a plunger travels longitudinally toward the lower bent end by electromagnetic means. When the longitudinally moving plunger strikes the bent end, the bar "undergoes lateral flexure excitation in the plane defined by the bent end." Neither of the Rowe references teach an instrument which is designed to be hand held when played or which can be played by simply shaking the instrument in a rotary fashion about a fixed point on the frame.

The prior art, while disclosing that a metal tube may be struck to generate a tone, does not teach any striker element which contacts the tubes to provide characteristic tones when a frame to which the striker elements and tubes are coupled is moved. In Deagan, it is noted, the sound is generated by the tubes moving and striking the cross-bars during their motion, thereby setting up vibration. That is, it is the movement of the bar rather than the hitting of a bar by a striker element which sets up the tone in the earlier Deagan patent. The Rowe patents, on the other hand, appear to preclude the generation of a tone by simply moving the frame of the apparatus, the Rowe method of generating the tone featuring the actuation of an electromagnet.

SUMMARY OF THE INVENTION

In accordance with the present invention, at least one tube is suspended between the upper cross-piece and lower cross-piece of a frame. On at least one side of the tube is a striker element which is proximate to the tube and which is also suspended by an elastic cord between the upper cross-piece and lower cross-piece of the frame. When the frame is shook or rocked about a stationary point on the lower cross-piece, each striker element reciprocates. In one direction of travel, the striker element contacts the tube proximate thereto. It is thus an object of the present invention to provide at least one elongated tube which is struck by one or a plurality of striker elements adjacent thereto when the instrument is shaken in a prescribed manner.

In a preferred embodiment of the invention, a plurality of tubes are provided, each tube being flanked on each side by a striker element proximate thereto, the tube and the two adjacent striker elements comprising a tube assembly. Between adjacent tube assemblies are positioned longitudinal frame pieces which extend from the upper cross-piece to the lower cross-piece. When the frame is set into motion, the striker elements in one direction strike the elongate tube and in the other direction strike one of the longitudinal frame pieces. In order to dampen the sound and to redirect the striking element toward the elongated tube, the longitudinal frame piece has a resilient pad thereon against which the striker element makes contact. It is thus another object of the present invention to generate and promote tones generated by the vibrating elongated tube while minimizing the tone generated when the striker element impacts a longitudinal frame piece.

The invention includes a damper which is selectively placed against one end of the elongated tube. Specifically, the damper is suspended between the upper cross-piece and the lower cross-piece by means of a damper cord, wherein tension on the damper cord can be applied or released in order to force the damper against or withdraw the damper from the tube. Means for varying the tension are provided proximate to the handle at which a player may hold the instrument. It is thus a further object of the invention to permit the player to control the tones generated by the instrument by controlling the damping of the various tubes selectively.

In accordance with the invention each tube is suspended by means of four tube cords, one pair of which extends from one side of the tube toward a first longitudinal frame piece and a second pair of which extends from the other side of the tube toward a second longitudinal frame piece. In one embodiment, each tube cord includes two parallel strands, with the striker element cord on each side of the tube being interposed between the strands of the tube cords on that side of the tube. The parallel tube cord strands define a path through which the striker element cord and the striker element attached thereto can follow. Alternatively and preferably, each striker element cord comprises a respective pair of parallel strands and each tube cord comprises a single strand disposed between a respective pair of striker element cord strands. In either embodiment, a striker element path is defined by the tube cords and striker element cords.

It is still yet another object of the present invention to provide at least one set of tube assemblies wherein each set of tube assemblies includes a plurality of tubes, each of which when struck, generates the same pitch in a distinct octave.

Further, it is still yet another object of the present invention to provide a plurality of sets of tube assemblies, where each set corresponds to a different pitch. The sets can be played together in hocket style to achieve an orchestrated sound, of harmonies, melodies, and syncopations previously unachievable by prior chime percussive instruments.

DESCRIPTION OF THE INVENTION

Figure 1:
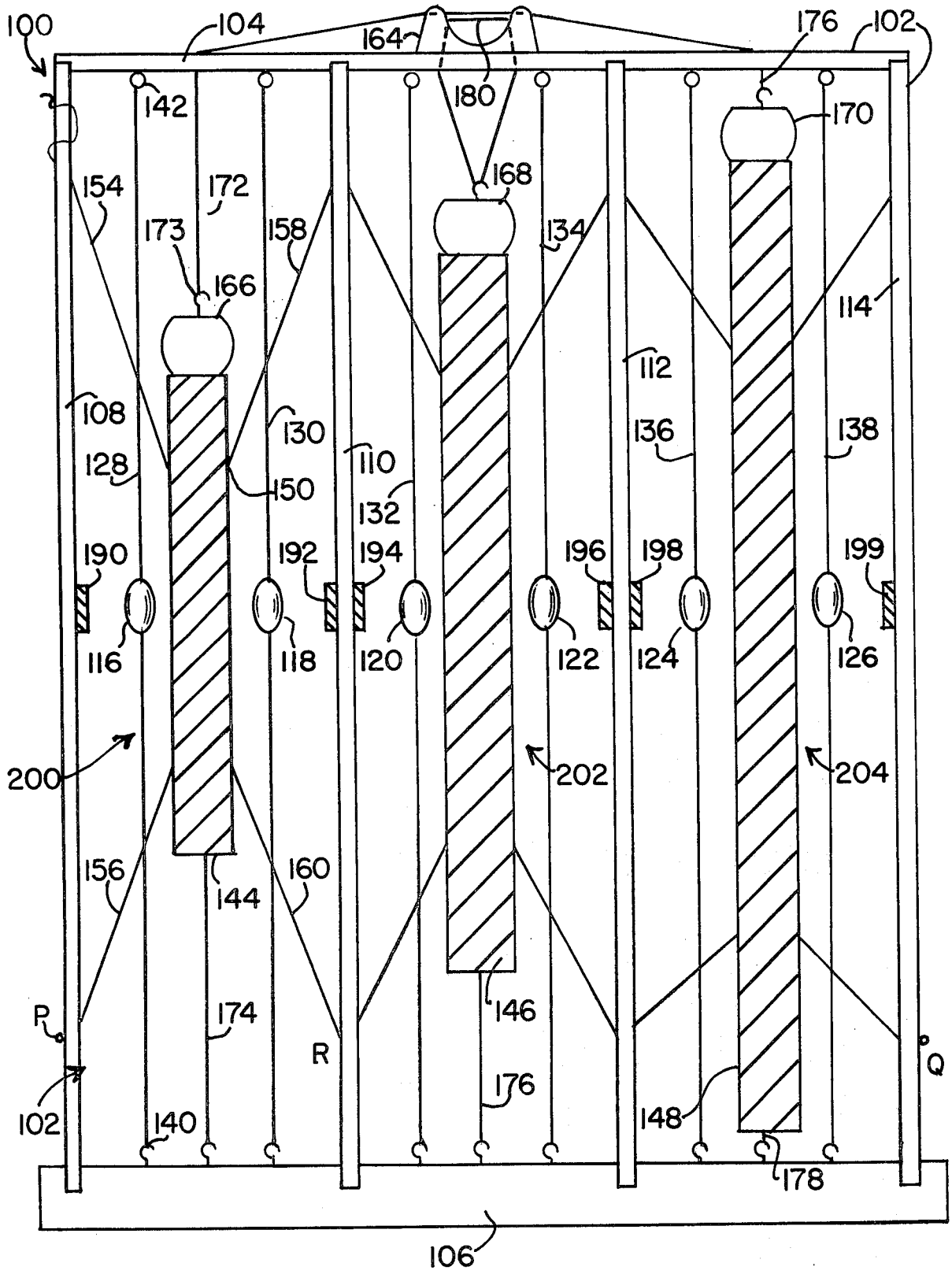
FIG. 1 is an illustration of a tube chimes in accordance with the present invention.

Referring to FIG. 1, a chime apparatus 100 is shown. The chime apparatus includes a frame 102 which includes an upper cross-piece 104, a lower cross-piece 106 and a plurality of longitudinal frame pieces 108, 110, 112 and 114. The frame 102 is preferably made of wood. The joints where the longitudinal frame pieces 108 through 114 are coupled to the upper cross-piece 104 and lower cross-piece 106 are notched and glued. Preferably, the frame 102 is 17 inches in width and 18 inches in length, although the dimensions may, of course, be varied as desired. Specifically, in order to produce higher or lower pitches, shorter or longer lengths of the longitudinal frame pieces may be required. In this regard, it is anticipated that lengths of between 12 inches and 24 inches may be required. Although not shown in the FIGURE, the depth of the frame 102 is, preferably, 1½ inches.

Suspended between the upper cross-piece 104 and lower cross-piece 106 are a plurality of striker elements 116, 118, 120, 122, 124 and 126. Each striker element 116 through 126 is suspended by a respective elastic cord 128 through 138. Each of these cords 128 through 138 are secured to the upper cross-piece 104 and the lower cross-piece 106 by, preferably, hooks and eyes—such as hook 140 and eye 142 for the striker element 116.

Also suspended between the upper cross-piece 104 and lower cross-piece 106 are a plurality of elongated tubes 144, 146 and 148. The elongated tubes 144 through 148 are each tuned to a given pitch such as C. Each tube is tuned to a distinct octave. The exact pitches and octaves are, of course, determined by the length of the tube. The tubes 144 through 148 are preferably made of a metal such as aluminum or the like. The manner in which the tubes 144 through 148 are suspended will be discussed with reference to tube 144.

Tube 144 has an upper node point (or more precisely, an upper node line) 150 and a lower node point 152. Extending down from the upper node point is a cord 154 which is attached to the longitudinal frame piece 108. Extending from the lower node point 152 is a second cord 156 which is also connected to the longitudinal frame piece 108. A third tube cord 158 extends from the upper node point 150 to the longitudinal frame piece 110. A fourth tube cord 160 extends from the lower node point 152 to the longitudinal frame piece 110. It will be noted that the cords 156 and 160 may comprise a continuous cord which starts at a point P and passes through each longitudinal frame piece and elongated tube enroute to a point Q at the lower right portion of the chime apparatus 100. Alternatively, of course, the cord may be segmented as desired. For example, cords 156 and 160 can be part of a single continuous cord which extends from point P to point R, at which points the continuous cord terminates and is fastened to the longitudinal frame piece 108 and 110, respectively. The same is, of course, true for the cords such as (145 and 158) passing through the upper nodes.

It should also be noted that each striker element cord 128 through 138 comprises two parallel strands. For example, one strand of the striker element cord 128 starts at hook 140 and extends upward and through eye 142 while the second strand continues from the eye 142 downward to the hook 140. (In this arrangement striker element 116 is, of course, coupled to both strands.) Interposed between the two strands of the striker element cords 128 through 138 are single-strand tube cords, such as cords 154 through 160, which are, preferably, nonresilient. Again by way of example, tube cords 154 and 156 lie between the two strands which comprise the striker element cord 128. The movement of the two strands of the striker element cord 128 is confined, by the tube cords 154 and 156, to a path that is substantially aligned with the plane containing the tube cords 154 and 156. Accordingly, the striker element 116 is confined to a path (in the plane of the FIGURE) whereby the striker element 16 moves between the tube 144 and pad 190 when the frame 102 is rocked. Alternatively, but less preferably, the tube cords can comprise double strands and the striker element cords can comprise a single strand travelling therebetween.

At the upper end of the frame 102 is located a handle portion 164 which a player of the instrument 100 can grasp. The lower hand preferably holds the center portion of the lower cross-piece 106.

At the top of each tube 144, 146 and 148 is a damper 166, 168 and 170, respectively. Dampers 166 and 170 are suspended between the upper cross-piece and the lower cross-piece by damper cords 172, 174 and 176, 178, respectively. It is noted that the damper cords 172 and 176 extend upward through the upper cross-piece 104 and pass upward to the handle portion 164. The dampers 166 and 170 are held, by tension, against the upper end of the respective tube 144 and 148. By pressing on the cord 172 proximate to the handle portion 164, the damper 166 moves upward. Similarly, applying tension to the cord 176 at a point proximate to the handle portion results in the damper 170 moving upward and away from the tube 148, resulting in an undampened tone. A similar effect is achieved by applying tension to the cord 180 which starts and ends at the damper 168. Accordingly, when any of the tubes are vibrating, the selective application of tension to the cords 172, 176 or 180 results in an undampened tone from the corresponding tube 144, 146 or 148. It will further be noted that a hook element 173 is provided as a coupling element between the damper 166 and the cord 172. Tension in the cord 172 can be varied, and hence, the damping varied by selectively screwing or unscrewing the hook 173 into the damper 166. Similar elements are also provided at the dampers 168 and 170.

When the instrument is played, the handle portion 164 is pivoted about a point preferably at the middle of the lower cross-piece 106. When this motion is performed, the striker elements 116 through 126 follow a path in the plane of the drawing, striking the corresponding tubes 144 through 148 as the striker elements 116 through 126 moves in one lateral direction. When moving in the opposite lateral direction, the striker elements 116 through 126 may travel far enough to strike a longitudinal frame piece 108 through 114. In order to dampen the sound of the striker elements 116 through 126 striking a longitudinal frame piece 108 through 114, and in order to rebound the striker elements 116 through 126 back toward its respective tube, each longitudinal frame piece 108 through 114 has a resilient pad 190 through 200 thereon, which is in the path of the striker elements 116 through 126. Thus, when the striker elements 116 through 126 move in one direction, it strikes the tube 144 through 148, and when it moves in the opposite lateral direction, it strikes the resilient pad 190 through 199, providing decreased sound and a rebounding toward its corresponding tube.

As previously noted, the tubes 144 through 148 provide a sound at a given pitch such as C. In this regard, it should be noted that each tube, together with the striker elements and the cords connected thereto, represent tube assemblies. For example, the tube 144, together with the striker elements 116 and 118 and the cords 128, 130, 154, 156, 158 and 160, represent a tube assembly 200. Similarly, tube assemblies 202 and 204 relate respectively to the tubes, striker elements and cords associated with the tubes 146 and 148. Together, the tube assemblies 200, 202 and 204 represent a single set of tube assemblies.

When the instrument is played by rocking the handle 164 with respect to a stationary point on the lower cross-piece 106, the various striker elements 116 through 126 strike the various tubes 144 through 148 producing vibrations. The vibrations in tube 144 will be at one octave at pitch C; the vibrations of tube 146 will be at a second octave at pitch C; and the vibrations from tube 148 will be at still a third octave at pitch C. Thus, the set which includes tube assemblies 200, 202 and 204 provide the pitch C at three different octaves. A second set of tube assemblies may, similarly, provide a second pitch at three octaves. By providing thirteen such sets, each note in the chromatic musical scale can be provided at three separate octaves. Hence, by selectively moving one of the thirteen sets, a selected pitch at three different octaves can be effected. Similarly, more or less sets may be included into a single instrument system.

It should be noted, as seen in the Figure, that the striker elements 116 through 126 are positioned proximate to the substantial midpoint of the tubes 114 through 148. This is preferable, although not necessary.

Further, it should be realized that the present invention is particularly adapted to hocket style playing. That is, each of a plurality of players controls one tube chimes 100 which corresponds to one of the thirteen notes in the chromatic scale. The respective tube chimes may be sounded in series or unison to create a desired orchestrated harmony or melody. Through successive, one-step octaving, an enrichment of various and subtle tone variations is realizable to achieve a musical, percussive effect previously unknown. The hocket style of playing permits numerous players to effect a magnificant interaction of tones and syncopations to please both the listener and the players. Moreover, the number of players and tube chimes 100 which can cooperate to achieve an orchestrated sound may vary greatly in number and may, it is noted, provide a range of tones more expansive than that of the 88-key piano.

It should be recognized that, by suspending the tubes 144 through 148, a pure ringing quality is produced when the tubes 144 through 148 are struck. Similarly, suspending the tubes from their respective node points also insures good ringing quality. Also, it is preferable that the tubes 144 through 148 be longitudinally centered in the frame so that the striker elements 116 through 126 strike the proper position which, preferably, is the mid-length of the tubes 144 through 148, respectively.

Although shown being suspended by an elastic cord extending from the upper cross-piece 104 and the lower cross-piece 106, the striker elements 116 through 126 may optionally be coupled to only the upper cross-piece 104, if desired.

In accordance with the invention, each striker element 116 through 126 is a heavy oval element of a substance such as lead, which can be secured to an elastic cord. The respective elastic cord permits the striker elements to repeatedly strike the respective tube as long as the frame is in motion. In addition, a single strike can be effected with only a single motion of the frame 102. It should also be noted that the pads 190 through 199, although preferably synthetic foam, may also be plastic, rubber or some similar material. The various dampers 166 through 170 are preferably round, rubber coverings over wooden balls which fit within the end of the respective tubes 144 through 148. In playing the instrument 100, one hand holds a point near the center of the lower cross-piece 106. The other hand holds the frame at the upper cross-piece 104 at the handle portion 164. The fingers on the hand near the handle portion 164 can be placed over the damper strings 172, 176 and 180, and pressed down and released as desired to effect a ringing or nonringing tone, respectively. By shaking the hand holding the handle portion 164, four distinct types of sound may be produced and controlled. With the damper strings 172, 176 or 178 released, a nonringing tone is produced while the frame is moved. Secondly, with the damper cords 172, 176 or 178 pressed, a louder ringing tone is produced during the prescribed motion. Thirdly, with the damper strings 172, 176 or 178 pressed down, it is possible to ring the respective tube only once with the short reciprocating motion. By releasing the respective damper string 172, 176 or 178, the tone can be defined in length. Finally, volume may also be controlled by the intensity of the movement of the upper cross-piece 104 by the hand holding the handle portion 164.

Other improvements, modifications and embodiments will become apparent to one of ordinary skill in the art upon review of this disclosure. Such improvements, modifications and embodiments are considered to be within the scope of this invention as defined by the following claims.

I claim:

1. A chime apparatus for producing tones, the apparatus comprising:

a frame having an upper cross-piece and a lower cross-piece; and at least one tube assembly, each tube assembly comprising (a) an elongated, longitudinally extending tube, (b) two striker elements, (c) means for suspending the tube between the upper cross-piece and the lower cross-piece, and (d) means for suspending each striker element (i) between the upper cross-piece and the lower cross-piece, and (ii) adjacent to the tube, the tube being positioned between the two striker elements; the tube and the striker elements being coupled to the frame such that the striker elements strike the tube to produce a characteristic tone in response to a prescribed movement of the frame.

2. A chime apparatus according to claim 1 further comprising:

at least one damper, each damper being selectively placed against one end of a corresponding tube; and means for adjusting how tightly each damper is placed against the tube corresponding thereto.

3. A chime apparatus according to claim 2 further comprising:

means for suspending the damper between the upper cross-piece and the lower cross-piece.

4. A chime apparatus according to claim 3 wherein the damper suspending means comprises:

at least one first damper cord extending from the damper to the upper cross-piece; and at least one second damper cord extending from the damper to the lower cross-piece;

wherein the tightness adjusting means comprises means for varying the tension in each of the at least one second damper cords.

5. A chime apparatus according to claim 4 wherein the chime apparatus is hand held, the apparatus further comprising:

a handle portion disposed along the upper cross-piece each of the at least one second damper cords of each tube assembly extending proximate to the handle portion, the tension in each of the at least one second damper cords being controllable by the fingers of a hand when engaging the handle portion.

6. A chime apparatus according to claim 4 wherein the frame further comprises:

a plurality of longitudinal frame pieces extending between the upper cross-piece and the lower cross-piece;

each tube assembly being flanked on each side thereof by two longitudinal frame pieces.

7. A chime apparatus according to claim 6 wherein each tube has an upper node point and a lower node point thereon, and wherein the tube suspending means for each tube comrprises:

a first exclusive pair of tube cords comprising (a) one tube cord which extends from the lower node point on the tube to a first longitudinal frame piece flanking the tube on a first side thereof, and (b) one tube cord which extends from the upper node point on the tube to the first longitudinal frame piece; and a second exclusive pair of tube cords comprising (a) one tube cord which extends from the lower node point on the tube to a second longitudinal frame piece flanking the tube on a second, opposite side thereof, and (b) one tube cord which extends from the upper node point on the tube to the second longitudinal frame piece.

8. A chime apparatus according to claim 7 further comprising:

means for guiding each striker element along a path either substantially toward or away from a respective tube.

9. A chime apparatus according to claim 8 wherein the striker suspending means comprises:

an elastic cord having two proximate, parallel strands extending between the upper cross-piece and lower cross-piece, the striker element being fixedly positioned along the elastic cord; and wherein the guiding means for each striker element comprises:

one of the exclusive pairs of tube cords and the elastic cord which is located on the same side of the tube as is the one exclusive pair, each tube cord being interposed between the two strands of the elastic cord which is located on the same side.

10. A chime apparatus according to claim 9 wherein the elastic cord comprises a continuous length of dual-strand cord wherein (a) the first strand extends from a first one of the cross-pieces, through the striker element and to the second one of the cross-pieces and wherein (b) the second strand continues from said second cross-piece, through the striker element, and to the first cross-piece, the elastic cord thereby starting and ending at least proximate to the first cross-piece.

11. A chime apparatus according to claim 10 wherein the striker elements are adjacent to substantially the mid-length of the tube and wherein the apparatus further comprises pads along the longitudinal frame pieces positioned in the path of a movable striker element, the striker element striking (a) substantially the mid-length of the tube when travelling along a path in one lateral direction, and (b) a pad on a longitudinal frame piece when travelling along a path in the other, opposite lateral direction, the path in either lateral direction being defined by the strands.

12. A chime apparatus according to claim 11 wherein the apparatus comprises:

a set of tube assemblies, each tube assembly thereof producing a tone (a) of a single predetermined pitch, and (b) in a distinct octave in response to the prescribed movement of the frame, the pitch and octave being substantially determined by the length of the tube in each assembly.

13. A chime apparatus according to claim 12 wherein the apparatus comprises:

a plurality of sets of tube assemblies, the tube assemblies in each set producing a distinct tone relative to the tube assemblies in other sets, the plurality of sets thereby including tube assemblies for producing tones (a) at various distinct pitches, and (b) in various octaves.

14. A chime apparatus according to claim 13 wherein the apparatus includes eight sets of tube assemblies, the tube assemblies in each set corresponding in pitch to a distinct one of the eight notes in the musical scale.

15. A chime apparatus according to claim 1 wherein the frame further comprises:

a plurality of longitudinal frame pieces extending between the upper cross-piece and the lower cross-piece;

each tube assembly being flanked on each side thereof by two longitudinal frame pieces.

16. A chime apparatus according to claim 15 wherein each tube has an upper node point and a lower node point thereon and wherein the tube suspending means for each tube comprises:

a first exclusive pair of tube cords comprising (a) one tube cord which extends from the lower node point on the tube to a first longitudinal frame piece flanking the tube on a first side thereof, and (b) one tube cord which extends from the upper node point on the tube to the first longitudinal frame piece; and a second exclusive pair of tube cords comprising (a) one tube cord which extends from the lower node point on the tube to a second longitudinal frame piece flanking the tube on a second, opposite side thereof, and (b) one tube cord which extends from the upper node point on the tube to the second longitudinal frame piece.

17. A chime apparatus according to claim 15 wherein the striker elements are adjacent to substantially the mid-length of the tube and wherein the apparatus further comprises pads along the longitudinal frame pieces, each pad being positioned in the path of a movable striker element, the striker element striking (a) substantially the mid-length of the tube when travelling along a path in one lateral direction, and (b) a pad on a longitudinal frame piece when travelling along a path in the other, opposite lateral direction.

18. A chime apparatus according to claim 1 wherein the striker suspending means for each striker element comprises:

an elastic cord passing from the striker element to the upper cross-piece and from the striker element to the lower cross-piece.

19. A chime apparatus according to claim 1 wherein the apparatus comprises:

a set of tube assemblies, each tube assembly thereof producing a tone (a) of a single predetermined pitch, and (b) in a distinct octave in response to the prescribed movement of the frame, the pitch and octave being substantially determined by the length of the tube in each assembly.

20. A chime apparatus according to claim 19 wherein the apparatus comprises:

a plurality of sets of tube assemblies, the tube assemblies in each set producing a distinct tone relative to the tube assemblies in other sets, the plurality of sets thereby including tube assemblies for producing tones (a) at various distinct pitches, and (b) in various octaves.

21. A chime apparatus according to claim 20 wherein the apparatus includes at least thirteen sets of tube assemblies, the tube assemblies in each set corresponding in pitch to a distinct one of the thirteen notes in the chromatic musical scale.

22. A chime apparatus for producing tones, the apparatus comprising:

a frame having an upper cross-piece and a lower cross-piece and at least two longitudinal frame pieces therebetween;

at least one striker element;

elastic means for suspending each striker element between the upper cross-piece and the lower cross-piece;

at least one elongated, longitudinally extending tube; and means for suspending each tube between the upper cross-piece and the lower cross-piece;

wherein each suspended striker element is laterally adjacent to one tube, wherein each tube and the striker elements adjacent thereto are flanked by two longitudinal frame pieces, and wherein the tubes and the striker elements are coupled to the frame such that the striker element contacts the tube adjacent thereto in response to a prescribed movement of the frame.

* * * * *